US012054912B2

(12) United States Patent
Arnal et al.

(10) Patent No.: US 12,054,912 B2
(45) Date of Patent: Aug. 6, 2024

(54) MOVABLE CONTROL MODULE FOR HYDRAULIC MACHINE WITH LOCKING FEATURE

(71) Applicant: Volvo Construction Equipment AB, Eskilstuna (SE)

(72) Inventors: Gregory Arnal, Avressieux (FR); Sylvain Houel, Le Bourget du Lac (FR); Edgar Bond, Vatilieu (FR)

(73) Assignee: Volvo Construction Equipment AB, Eskilstuna (SE)

( * ) Notice: Subject to any disclaimer, the term of this patent is extended or adjusted under 35 U.S.C. 154(b) by 344 days.

(21) Appl. No.: 17/622,163

(22) PCT Filed: Jul. 11, 2019

(86) PCT No.: PCT/EP2019/068709
§ 371 (c)(1),
(2) Date: Dec. 22, 2021

(87) PCT Pub. No.: WO2021/004637
PCT Pub. Date: Jan. 14, 2021

(65) Prior Publication Data

US 2022/0356673 A1 Nov. 10, 2022

(51) Int. Cl.

| | |
|---|---|
| ***E02F 9/16*** | (2006.01) |
| ***E02F 9/20*** | (2006.01) |
| *E02F 3/32* | (2006.01) |

(52) U.S. Cl.
CPC ..... *E02F 9/2004* (2013.01); *E02F 9/16* (2013.01); *E02F 3/325* (2013.01)

(58) Field of Classification Search
CPC ..... G05G 2009/047; E02F 9/2004
See application file for complete search history.

(56) References Cited

U.S. PATENT DOCUMENTS

| | | | | |
|---|---|---|---|---|
| 4,237,629 | A | 12/1980 | Schmidt | |
| 5,860,488 | A | 1/1999 | Kim | |
| 2004/0154427 | A1* | 8/2004 | Jo | G05G 1/62 74/525 |

FOREIGN PATENT DOCUMENTS

| | | | | |
|---|---|---|---|---|
| JP | 2000148270 | A * | 5/2000 | E02F 9/2004 |
| JP | 2002149255 | A * | 5/2002 | B60N 2/797 |

(Continued)

OTHER PUBLICATIONS

JP 2000-148270 (Year: 2000).*

(Continued)

*Primary Examiner* — Randell J Krug
(74) *Attorney, Agent, or Firm* — Sage Patent Group

(57) ABSTRACT

A control module configured to be part of a control station inside a cabin of a machine: includes a fixed support, a main body movably mounted on the support between a work position and a retracted position, a locking means to lock the main body in the work position, the locking means can be operated between an unlocked state and a locked state in which they keep the main body in its work position The control module also includes an elastic means which is compressed when the locking means are operated between the unlocked state and an intermediate unstable state, and a sensor enabling activation of at least one power circuit of the machine only when the locking means move from the intermediate unstable state to the locked state.

21 Claims, 7 Drawing Sheets

(56) References Cited

FOREIGN PATENT DOCUMENTS

| | | | |
|---|---|---|---|
| JP | 2002149255 | A | 5/2002 |
| JP | 2009299287 | A | 12/2009 |

OTHER PUBLICATIONS

JP 2002-149255 (Year: 2002).*
International Search Report and Written Opinion of the International Searching Authority, PCT/EP2019/068709, mailed Mar. 17, 2020, 11 pages.

* cited by examiner

MOVABLE CONTROL MODULE FOR HYDRAULIC MACHINE WITH LOCKING FEATURE

CROSS REFERENCE TO RELATED APPLICATIONS

This application is a 35 U.S.C. § 371 national stage application of PCT International Application No. PCT/EP2019/068709 filed on Jul. 11, 2019, the disclosure and content of which is incorporated by reference herein in its entirety.

FIELD OF THE INVENTION

The invention relates to a movable control module for a machine (construction equipments, offroad, crane . . . ) with a locking system. This particularly concerns a control module movable between a retracted position and a work position to release a clear passage in and out a cabin of the machine. The invention is also directed to a system to implement such a control module.

The invention also relates to a cabin of a machine equipped with such a control module. This disclosure also relates to a machine equipped with such a control module.

BACKGROUND OF THE DISCLOSURE

In the field of machines, such as the ones having hydraulics powered machinery (construction equipments, offroad, crane . . . ), a control module is often provided to a user of the machine to control functions of the machine. Such a control module is commonly part of a control station that is usually located inside a cabin of the machine. The control station often comprises a seat for comfort of the user.

The control module comprises a main body extending mainly in a direction of the machine's normal forward movement. The main body defines a top surface on which is mounted at least one human-machine interface, which is for example a joystick. The control module is disposed on the right or on the left of the user installed at the control station to be easily maneuvered. Also, the control module usually comprises an armrest for comfort of the user. The control module, in such an arrangement, is said herein to be in a work position wherein the user installed in the control station is able to hold and move the joystick to control functions of the machine.

Space in the control station is often limited and the control module generally obstructs the passage in and out of the control station. For this reason, it is known in the art to rotatably mount the control module on a frame of the control station around an axis substantially horizontal and transverse to the forward direction of the machine. Therefore, the control module can rotate between the work position and a retracted position wherein the control module is held backward to lie in a substantially vertical position. In the retracted position, the passage in and out of the control station is cleared of the control module. A gas spring is provided between the control module and the frame to maintain the control module in the work position or in the retracted position.

However, the movement of rotation of the control module as previously described requires a lot of space inside the cabin.

Also, a gas spring usually does not provide enough resistance to safely secure the control module in the work position or in the retracted position. Additionally, construction machines comprising a control module of the known art are regularly used in all types of climate, while gas spring resistance depends on outside temperature. Consecutively, reliability of the locking provided by a gas spring cannot be guaranteed for all applications of the machine.

Alternatively, a control module as previously described can comprise a mechanical lock for locking the control module in the work position. Such a mechanical lock is usually composed of a lever to be operated by the user. This lever is adapted to displace and rotate a lock strike of the control module on a bolt of the frame. This provides a reliable locking of the control module in the work position. However, the control module is not still safely locked in the retracted position: vibrations and movements of the machine during its shipment or its transportation can provoke the control module to move away from its retracted position.

A contact sensor is commonly mounted on the control module and is adapted to slide on a cam of the frame when the control module is rotated from the work position to the retracted position. When the control module is rotated from the work position toward the retracted position, the contact sensor is then actuated by contact on the cam. Actuation of the sensor deactivates the power circuits controlled by the joystick mounted on the top surface of the control module which is in retracted position. Therefore, functions of the machine cannot be actuated while the control module is retracted position. Indeed, having the control module in the retracted position means that the functions of the machine are not supposed to be actuated. Moreover, as the machine is not supposed to be actuated, people can eventually stand near to the machine or the machine can be parked in a tiny location. In these conditions, deactivation of the joystick when the control module is in the retracted position prevents from hurting someone standing near to the machine or from damaging the machine by an unwanted motion of the machine.

Even though functions of the machine are deactivated when the control module is the retracted position, there is an all range of positions of the control module between the work position and the intermediate position in which the contact sensor is actuated. So, there is a risk of unwanted actuation of the functions of the machine during that range of motion of the control module.

At last, the arrangement of the sensor on the cam generates difficulties for calibrating the sensor with precision. Therefore, safety issues arise because activation of the machine while the control module is in the retracted position can cause accidents of people or damage of the machine.

Therefore, the inventors have endeavored to find improved solutions for managing these issues of economy of space, calibration and actuation of the sensor and locking of the control module.

SUMMARY OF THE DISCLOSURE

The purpose of the disclosure is to bring a simple, efficient and affordable solution.

For that purpose, there is disclosed a control module configured to be part of a control station inside a cabin of a machine, the control module comprising:

- a fixed support,
- a main body movably mounted on the support between a work position and a retracted position,
- a locking means to lock the main body in the work position, the locking means can be operated between an unlocked state in which they do not prevent the main body from moving and a locked state in which they keep the main body in its work position, wherein, between the unlocked state and the locked state, the locking means reach an intermediate unstable state wherein the control module also includes an elastic means which is compressed when the locking means are operated between the unlocked state and the intermediate unstable state and which forces the locking means in a direction away from the intermediate unstable state, wherein the control module also includes a sensor enabling activation of at least one power circuit of the machine, wherein the sensor is arranged to be actuated only when the locking means move from the intermediate unstable state to the locked state.

The term "intermediate unstable state" refers here to an unstable mechanical equilibrium state in which the locking means have a natural tendency to move away from it.

Terms referring to "work position" and "retracted position" have the same meaning than that described for a control module of the known art.

The elastic means have to be intentionally compressed to enable the locking means to be transferred from the unlocked state to the locked state by overcoming the unstable state. Thus, such a control module provides a better locking of the main body in the work position.

Indeed, in order to move the main body from the retracted position to the work position, the operator must exert an effort exceeding a threshold effort to enable the compression of the elastic means in order to lock the main body into the work position.

This control module also provides more overall safety around the machine because activation of the machine can only occur when the main body is locked in the work position after having overcome the unstable state of the locking means. This means that hydraulic powered functions of the machine cannot be actuated while the main body of the control module is between the retracted position and the unstable state.

According to one aspect, the main body can be moved from the retracted position to the work position, and inversely, by operating the locking means.

Therefore, both operations consisting of moving the main body and locking the main body can be realized by only moving the locking means which allows an easier and more intuitive operation of the main body and creates a more compact control module. A single control member is also sufficient to move and to lock the main body.

The control module may further include guiding means for guiding the main body in its movement relative to the support, the guiding means comprising preferably at least one pivotable rod.

This constitutes a reliable and sturdy mount arrangement.

Preferably, the guiding means provide to the main body a motion of circular translation relative to the support.

Compared to a simple rotation, a circular translation motion reduces the space occupied by the control module during the movement of the main body between the retracted position and the work position. Therefore, there is more space available in the control station due to the circular translation motion of the main body.

Also, circular translation motion allows the top surface of the main body to remain flat during all range of motion. Then, items can be disposed on the top surface of the main body without being dropped while the main body is moved between the work position and the retracted position.

Advantageously, the main body includes an armrest.

An armrest provides more comfort for a user operating the machine in the control station.

Advantageously, the main body includes a recess area on its top surface.

A recess area can be arranged on the top surface of the main body to receive items, such as beverages cans or coins.

According to one aspect, the locking means comprise a first locking lever extending from a first end to a second end, the first locking lever being pivotally connected at an intermediate location between the first end and the second end to the main body for rotation around a first axis and pivotally connected at the second end to a first end of a second locking lever for rotation around a second axis spaced apart from the first axis, a second end of the second locking lever being connected to at least one pivotable rod that preferably enables guiding the main body in its movement relative to the support, for rotation around a third axis spaced apart from the first axis and the second axis, the first locking lever and the second locking lever forming a toggle clamp linkage.

An arrangement of the locking means as described herein allows a cost effective solution.

According to one aspect, the locking means comprise an operating handle.

The handle allows an operator to easily actuate the locking means.

Advantageously, the operating handle is located at the first end of the first locking lever and wherein the dimension of the first locking lever between the axis L1 and the axis L2 is superior to the dimension of the second locking lever between the axis L2 and the axis L3.

This limitation reduces the range motion of the first locking lever necessary to move the main body between the retracted position and the work position. This way, the control module is globally more compact. Also, the operator of the machine can move and lock the main body by driving the handle of the first locking lever over a shorter range of motion.

Advantageously, the main body comprises an abutment to cooperate with the first locking lever when the locking means are in the locked state.

The abutment has a first purpose, which is to limit the movement of the first locking lever in the locked state. The abutment can also be used to calibrate the location of the sensor to ensure that the sensor will never be activated before that the locking means have overcome the intermediate unstable state to be in the locked state. In the case of a mechanical sensor, the abutment will also ensure that the sensor is not damaged by the first locking lever.

According to one aspect, the elastic means is a rubber pad attached to the support and adapted to be compressed by the main body.

A rubber pad is a cost effective elastic means solution that can endure repetitive efforts of compression.

According to one aspect, the sensor is a contact sensor arranged to be actuated by the locking It enhances safety because actuation of the sensor by contact with the locking means can only be done by overcoming the intermediate unstable state with an effort of the user above a threshold effort required for compression enough the elastic means.

Alternatively the sensor may be a hall-effect sensor, a proximity sensor or micro switch.

According to one aspect, the control module may further include an emergency system adapted to move the locking means from the locked state towards the unlocked state in order to de-activate the sensor.

The emergency system enables a faster deactivation of the hydraulics of the machine than unlocking the locking system by compressing back the elastic means in order to move the locking means from the locked state to the unlocked state. The emergency system can also deactivate the functions of the machine if, for any reason, the locking means are blocked.

According to one aspect, the control module further comprises holding means for holding the main body in the retracted position.

Locking the main body in the retracted position is advantageous to ensure that the passage in or out of the cabin remain free while an operator moves in or out of the cabin or that the main body doesn't move while the machine is carried over for transportation or shipment.

Advantageously, the holding means comprise a shoulder configured to retain the locking means when the main body is in the retracted position.

In one embodiment, the control module further comprises a joystick for controlling functions of the machine, the joystick being mounted on the main body.

The joystick may be a hydraulic joystick or an electric joystick or a hybrid joystick.

According to one aspect of the invention, the return force of the elastic means forces the locking means to move from the intermediate unstable state to the locked state.

This configuration enables that once the locking means are moved into the intermediate unstable state, they are spontaneously moved towards the locked state in order to lock the main body into the work position.

According to another aspect of the invention, the operation of the locking means between the unlocked state and the intermediate unstable state forces the main body to move, from its retracted position, forward and wherein the elastic return force of the elastic means forces the locking means to move from the intermediate unstable state to the locked state and forces simultaneously the main body to move backwards until it reaches the work position.

Locking means are spontaneously moved from the intermediate unstable state by the return force of the elastic means on the main body. Therefore, the main body is moved into the work position which is slightly backward relative to its forward end position while the locking means are in the intermediate unstable state.

According to another aspect of the invention, the elastic means remains compressed when the control module is in the work position, and therefore exerts on the main body an elastic return force tending to push the main body backwards, i.e. in direction of the retracted position.

Rubber pad positioned between the support and the main body closes all potential mechanical clearances between the support, the main body and the locking means when the main body is in work position, thus maintaining tension between those elements and creating solidity and compactness of the whole control module. This also gives the operator a good impression, as the control module really appears to be securely locked. Advantageously, the compressive force of the elastic means is maximum when the locking means are in the intermediate unstable state. The disclosure is also directed to a control station or seat comprising a control module as described above.

The disclosure is also directed to a machine such as a hydraulic machine comprising a control module as described above.

BRIEF DESCRIPTION OF THE DRAWINGS

Other features and advantages of the invention appear from the following detailed description of two of its embodiments, given by way of non-limiting example, and with reference to the accompanying drawings, in which.

DETAILED DESCRIPTION OF THE DISCLOSURE

In the figures, the same references denote identical or similar elements.

Figure 1:
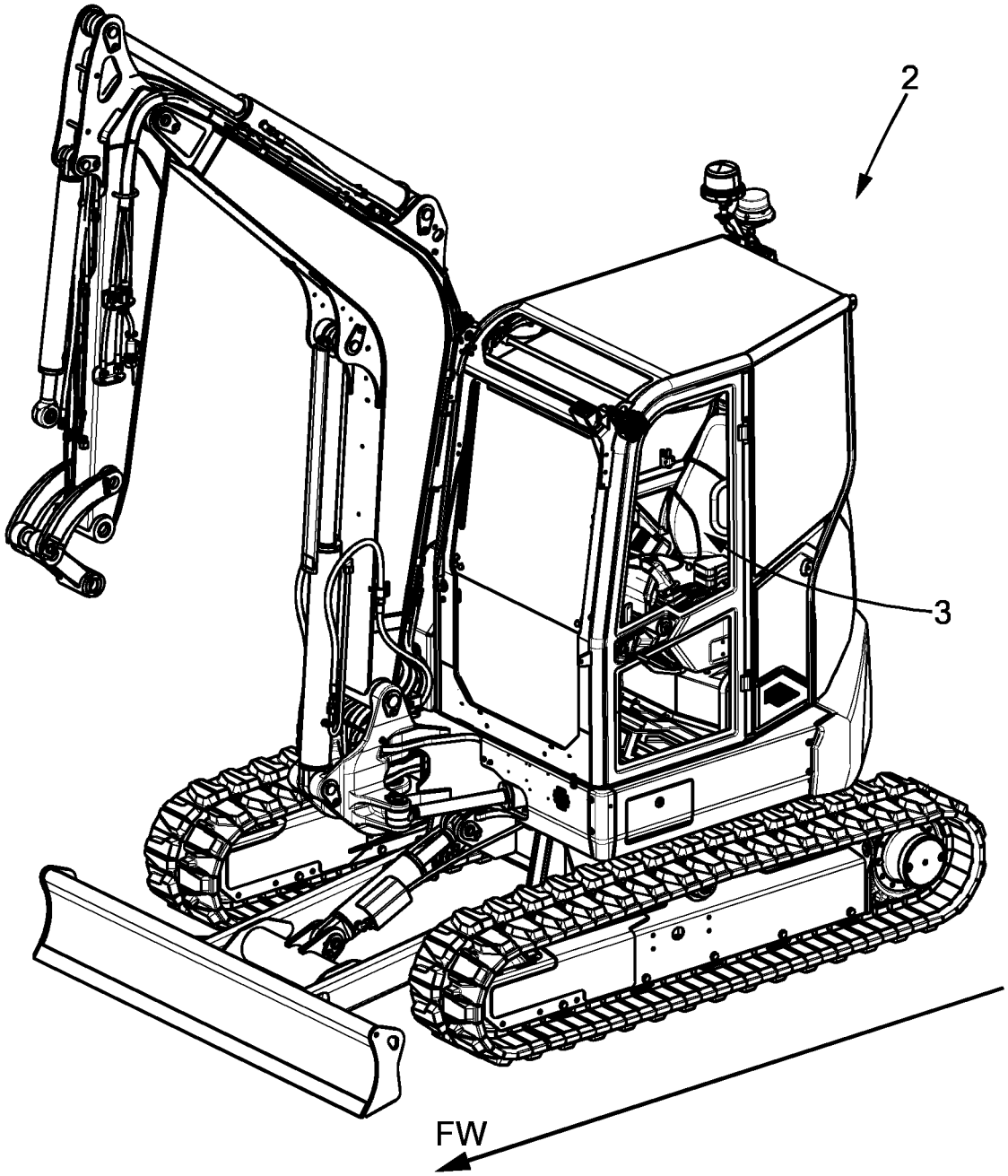
FIG. 1 illustrates a machine comprising the control module according to the disclosure.

FIG. 1 shows a machine comprising a control module 1 described hereinafter. The machine of FIG. 1 is depicted in specific example as an excavator but other types of vehicles may be suitable to comprise the control module 1 of the disclosure. A non-exhaustive list of such vehicles comprises construction equipment, heavy equipment, off-road vehicles and cranes.

The machine comprises a cabin 2 provided with a door. The cabin 2 includes a control station 3 where a user of the machine stands or sits in order to either drive the machine or control the functions of the machine by means of a control module 1. Here, the functions of the machine are understood as hydraulic powered attachments consisting, in FIG. 1, of a bucket. However, any other types of functions that can be operated by vehicles as mentioned above may be considered. The arrow of FIG. 1 represents a longitudinal direction FW which is the direction of the machine's normal forward movement.

Figure 2A:
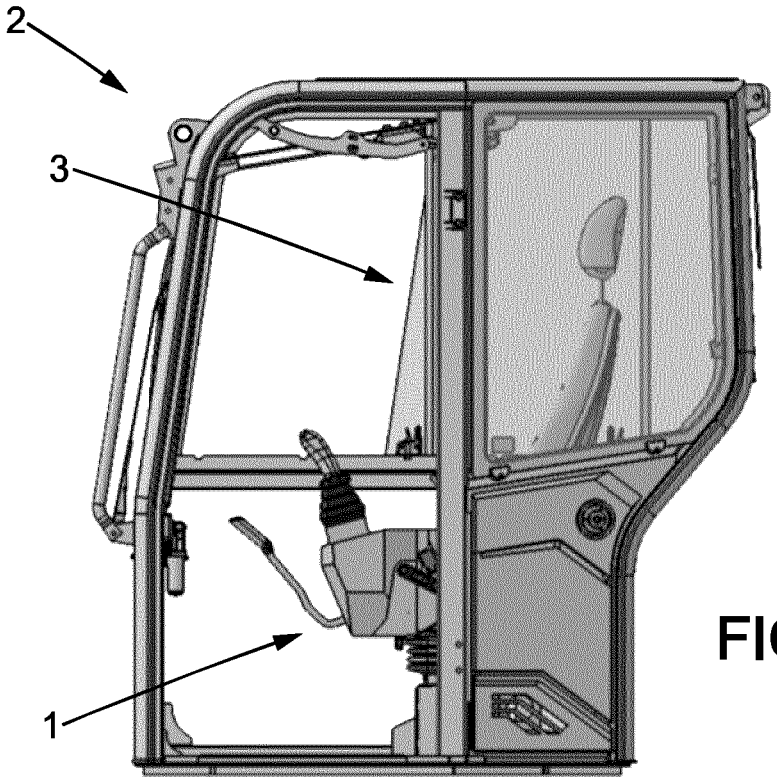
FIG. 2 illustrates the cabin of the machine with the control module in a work configuration and a retracted configuration, FIG. 3 diagrammatically illustrates the control module according to a first embodiment with the main body in the retracted position, FIG. 4 diagrammatically illustrates the control module according to a first embodiment with the main body between the retracted position and the work position, FIG. 5 diagrammatically illustrates the control module according to a first embodiment with the main body in the work position.
Figure 2B:
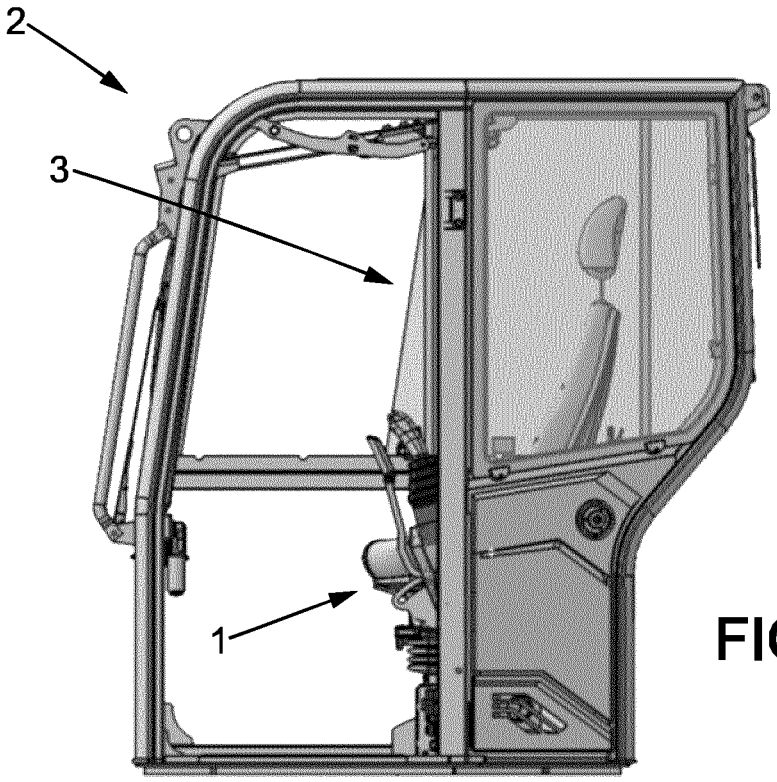

The example of the control station 3 in FIGS. 1 and 2 comprises a seat and a control module 1. A human-machine interface (HMI) is mounted on the control module 1. The human-machine interface is connected to at least one power circuit of the machine allowing the user to control functions of the machine. As shown in FIGS. 1 to 9, the human-machine interface may be a joystick 5. In particular, it can be a hydraulic joystick 5. As it can be seen in FIG. 2, the control module 1 is adapted to be longitudinally adjusted between a work position (WP) and a retracted position (RP).

In the work position, the control module 1 is located on the left and slightly on the front of the user seated in the control station 3. As space inside the cabin 2 is limited, the passage in and out by the door of the cabin 2 is obstructed by the control module 1 when it is in the work position.

In the retracted position (or configuration), the control module 1 is moved backwards and located on the left of the user and at the same time liberating space to move in or out of the control station 3.

The control module 1 described hereinafter may alternatively be located on the right of the user. The control station 3 may also include two control modules 1 of the disclosure on both sides of the user.

In what follows, the term "inner" is used to denote the lateral side of the control module 1 facing the seat and the term "outer" is used to denote the opposite lateral side of the control module 1 (facing the cabin door).

As represented in FIGS. 2 to 11, the control module 1 comprises a support 4. The support 4 is attached to the control station 3. In particular, the support 4 is attached to a frame supporting the seat of the control station 3, as depicted in FIG. 2. The support 4 takes a shape of a vertical plate extending longitudinally. A tab portion 42 projects laterally outwardly from a lower portion of the support 4. A first arcuate slot 41 extends longitudinally across the upper portion of the support 4 between a forward end and a rear end.

In addition, the control module 1 comprises a main body 10, as shown in FIGS. 2 to 11. The main body 10 has approximately the shape of a case with an inner wall 11, an outer wall 12 and a front wall 13. The main body 10 also comprises a top wall 15 and a bottom wall 14 both lying mainly horizontally. The top wall 15 of the main body 10 may comprise a first aperture adapted for fixing the joystick 5 to the control module 1.

Besides, the hydraulic pipe system of the joystick 5 for connection with the functions of the machine can be arranged between the inner and outer lateral walls of the main body 10 and exit by the rear open side of the main body 10. The top wall 15 of the main body 10 shows a top surface.

The top surface of the main body 10 may define an armrest for the user of the machine. The top surface may also define a recess 18. The recess 18 can be adapted to receive beverage containers or any personal belongings.

Figure 3:
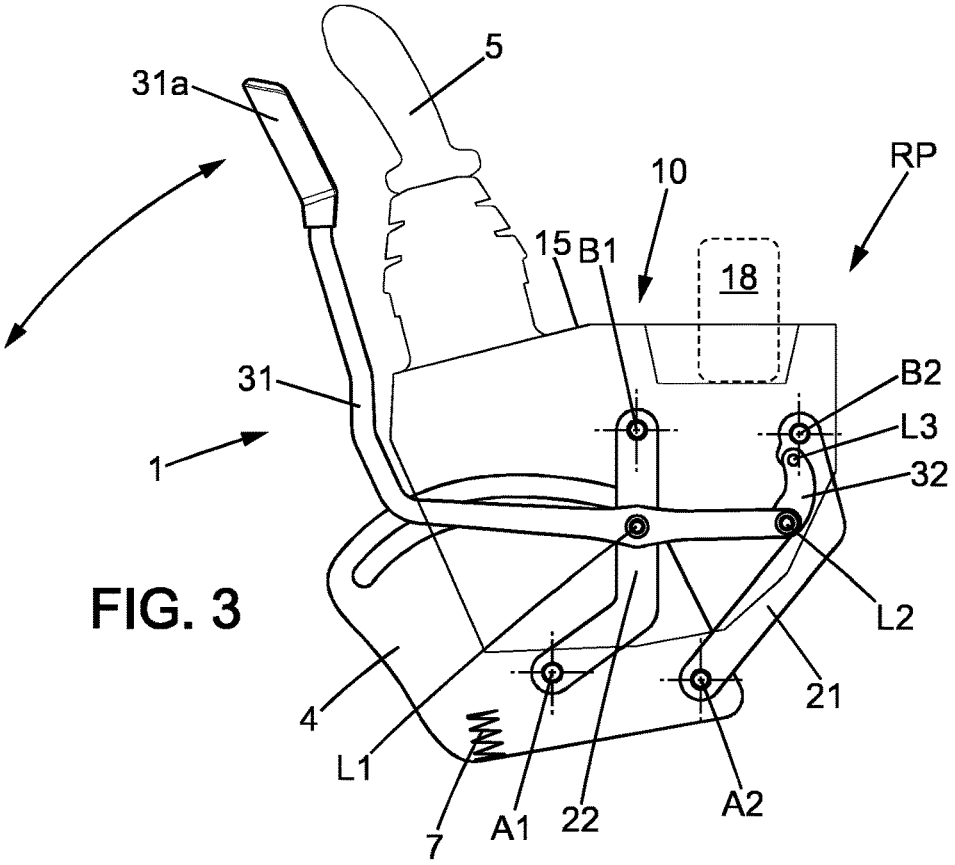
Figure 5:
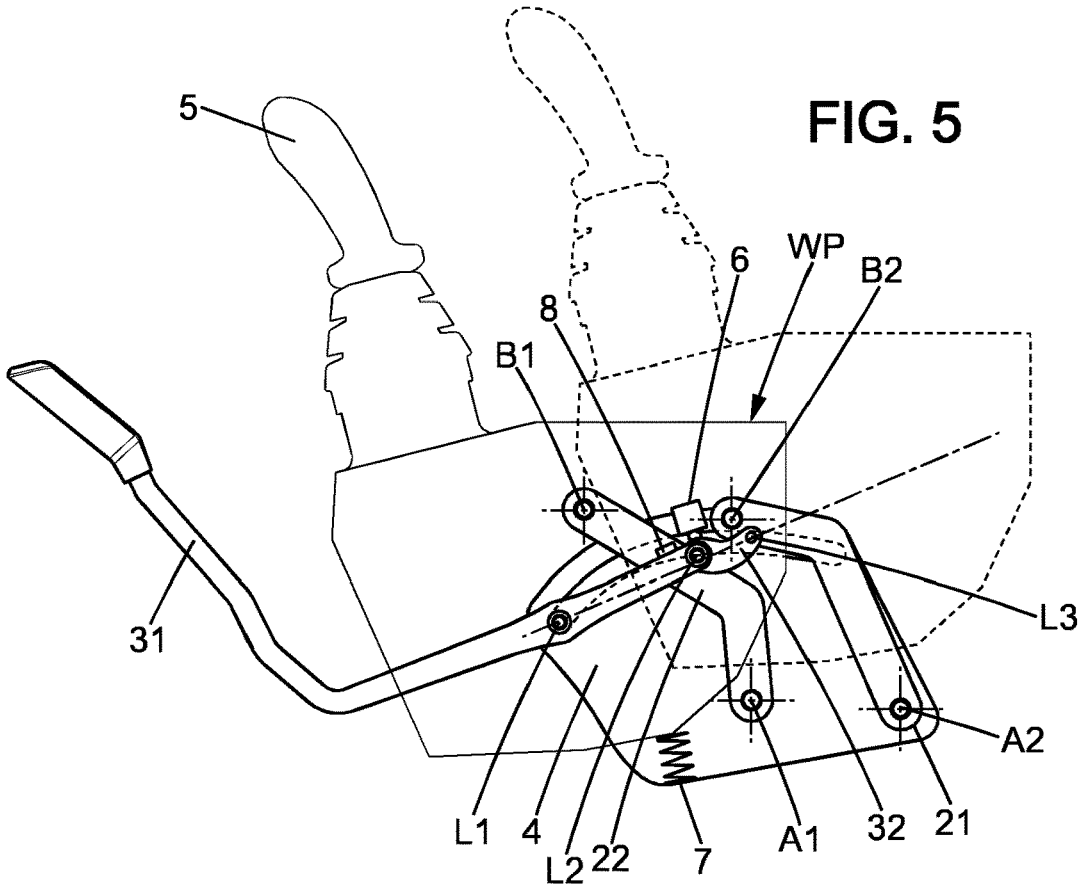

The main body 10 is movable relative to the support 4 between a retracted position RP shown in FIG. 3 and the right side of FIG. 2 and a work position WP shown in on the left side of FIG. 2 and FIG. 5. In the retracted position, the main body 10 is located in a longitudinally backward position relative the support 4. In the work position, the main body 10 is in a longitudinally forward position relative to the support 4.

Furthermore, the control module 1 is provided with guiding means 20 to guide the movement of the main body 10 relatively to the fixed support 4. The guiding means 20 comprise at least a first pivotable rod 21. This first pivotable rod 21 is pivotally connected at a first end to the support 4 for rotation around a shaft having a transversal axis A2. The axis A2 is substantially located at a rear end of the lower portion of the support 4. The first pivotable rod 21 is pivotally connected at a second end to the main body 10 for rotation around a shaft having a transversal axis B2. In particular, the first pivotable is pivotally connected to the inner wall 11 of the main body 10. The axis B2 is located at the rear of the inner wall 11 of the main body 10. The first pivotable rod 21 is then located between the inner wall 11 and the outer wall 12 of the main body 10.

Referring to FIGS. 2 to 8 concerning a first embodiment of the control module 1, the guiding means 20 comprise a second pivotable rod 22. The second pivotable rod 22 is pivotally connected at one end to the support 4 for rotation around a shaft having a transversal axis A1 which is substantially located forward to the transversal axis A2. The second pivotable rod 22 is pivotally connected at a second end to the main body 10 for rotation around a shaft having a transversal axis B1 which substantially located forward to the transversal axis B2. In particular, the second pivotable rod 22 is pivotally connected to the outer wall 12 of the main body 10. The second pivotable rod 22 is then located on the outer side of the outer wall 12 of the main body 10.

Figure 9:
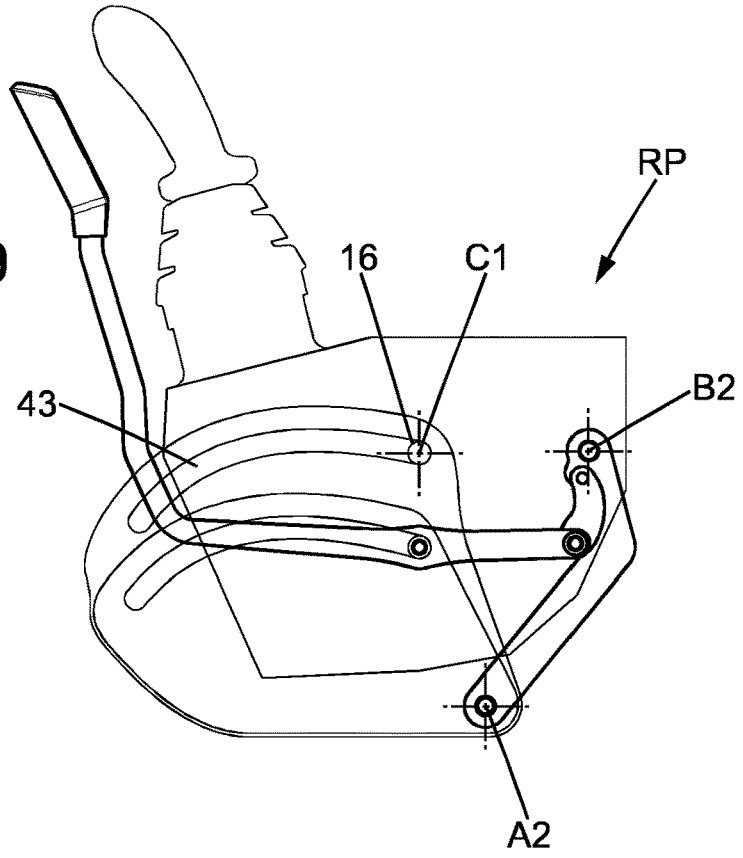
Figure 10:
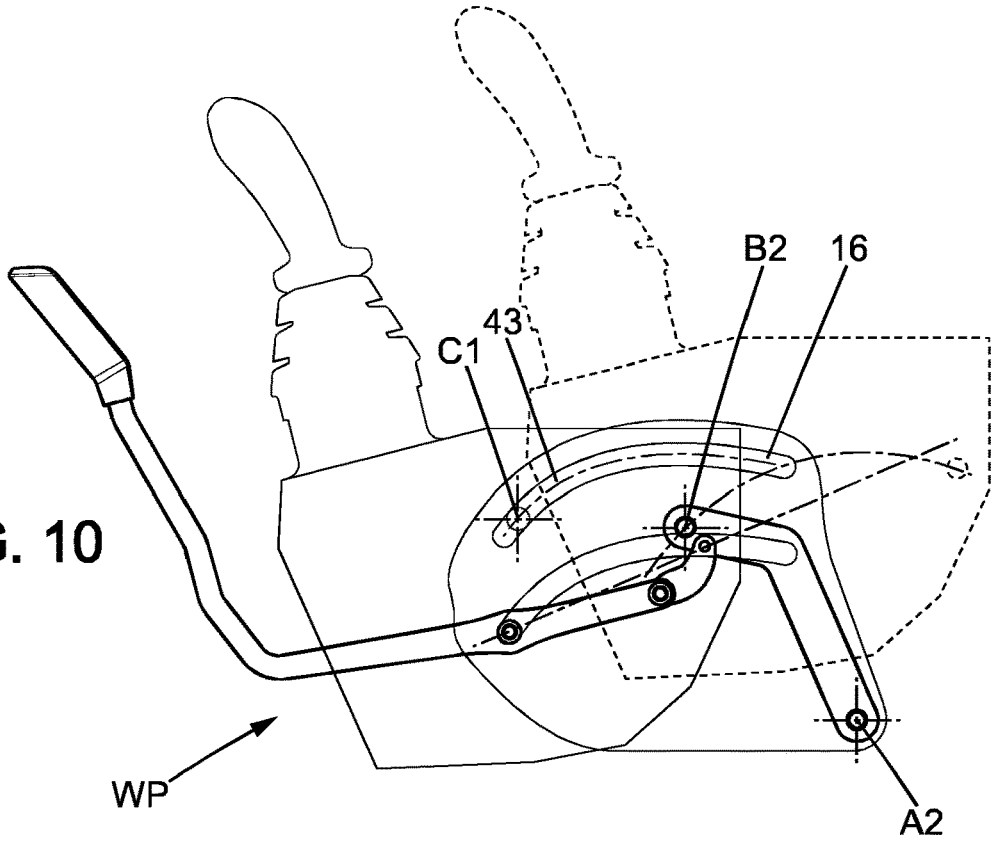

Referring to FIGS. 9 and 10 concerning a second embodiment of the control module 1, the guiding means 20 are further made of a second arcuate slot 43 extending longitudinally in the upper portion of the support 4. The second arcuate slot 43 may be positioned above the first arcuate slot 41. The second arcuate slot 43 is intended to cooperate with an inner end of a transversal pin 16 having a transversal axis Cl and mounted on the inner wall 11 of to the main body 10.

Both embodiments of the guiding means 20 enable moving the main body according to a motion of circular translation. The motion of circular translation maintains a constant orientation of the main body 10 through its all range of motion (which is circular or curved). Consequently, the top surface of the main body 10 remains horizontal during the all range of motion of the main body 10. Therefore, personal belongings or beverages containers can be disposed in the recess 18 of the top surface without being dropped from the top surface as the main body 10 is moved. The circular translation of the main body 10 also provides a motion that occupies less space in the cabin 2 in comparison to a regular rotation, as it is commonly used in the known systems.

As shown in FIGS. 2 to 11, the control module 1 comprises a first locking lever 31 extending longitudinally from a first end to a second end. A first portion comprising the first end of the first locking lever 31 is located substantially outside of the main body 10 and forward relative to the front wall 13 of the main body 10. The first end of the first locking lever 31 is also provided with an operating handle 31*a*. The operating handle 31*a* is then located substantially forward relative to the main body 10.

A second portion of the first locking lever 31 comprising the second end of the locking lever lies inside the main body 10 between the inner wall 11 and outer wall 12 of the main body 10. Therefore, the first locking lever 31 passes through a vertical slot 17 of the front wall 13 of the main body 10. The outer edge of the vertical slot 17 may present a shoulder 19 represented on FIG. 11. In an alternative embodiment not shown, the shoulder 19 may be located on the inner edge of the vertical slot 17. The shoulder 19 includes a horizontal flange.

The first locking lever 31 is pivotally connected at an intermediate position between the first end and the second end to the main body 10 for rotation around a first axis L1. The intermediate position is located inside the main body 10 between the inner wall 11 and the outer wall 12. This pivotal connection is carried out by a transversal shaft 47 passing though the intermediate position of the first locking lever 31 and through the inner lateral wall of the main body 10. The inner end of the shaft 47 is enclosed in the first arcuate slot 41 of the support 4. The first locking lever 31 is pivotally connected at the second end to a first end of a second locking lever 32 for rotation around shaft having a second axis L2 spaced apart from the first axis L1. The second locking lever 32 extends longitudinally between a first end and a second end. The second end of the second locking lever 32 is connected to the at least one pivotable rod of the guiding means 20 for rotation around a shaft having a third axis L3 spaced apart from the first axis L1 and the second axis L2. The first locking lever 31 and the second locking lever 32 forming a toggle clamp linkage.

Because of the pivotable connection between the first locking lever 31 and the main body 10 and because of the pivotable connection between the second locking lever 32 and the at least one pivotable rod, it is therefore possible to move the main body 10 between the work position and the retracted position by operating (manually) the locking means 30. More specifically, moving the main body 10 between the retracted position and the work position can be done by only operating the first locking lever 31. A user can then move the main body 10 by holding the operating handle 31*a* located at the first end of the first locking lever 31 to both actuate the locking means 30 and move the main body 10.

Precisely, the user pulls the handle 31*a* toward him (backwards) to move the main body 10 from the work position to the retracted position and pushes the handle 31*a* forward, i.e. moves the handle 31*a* away from him, to move the main body 10 from the retracted position to the work position.

Preferably, the dimension of the first locking lever 31 between the axis L1 and the axis L2 is greater than the dimension of the second locking lever 32 between the axis L2 and the axis L3. This limitation leads to reduce the range of motion of the first locking lever 31 required to move the main body 10 between the retracted position and the working position. Also, the user of the machine can move and lock the main body 10 by driving the operating handle 31*a* of the first locking lever 31 over a shorter range of motion.

The inner end of the transversal shaft 47 enclosed in the first arcuate slot 41 of the support 4 abuts the rear end of the first arcuate slot 41 when the main body 10 is in the retracted position. On the contrary, the inner end of the transversal shaft 47 enclosed in the first arcuate slot 41 of the support 4 is near to the forward end of the slot when the main body 10 is in the work position. The inner end of the shaft 47 slides inside the first arcuate slot 41 during the movement of the main body 10 between the retracted position and the work position.

The shoulder 19 of the vertical slot 17 of the front wall 13 of the main body 10 is adapted to retain the first locking lever 31 when the main body 10 is in the retracted position. Therefore, it is possible to prevent the locking means 30 (and the main body 10) from moving when the latest is in the retracted position.

Figure 4:
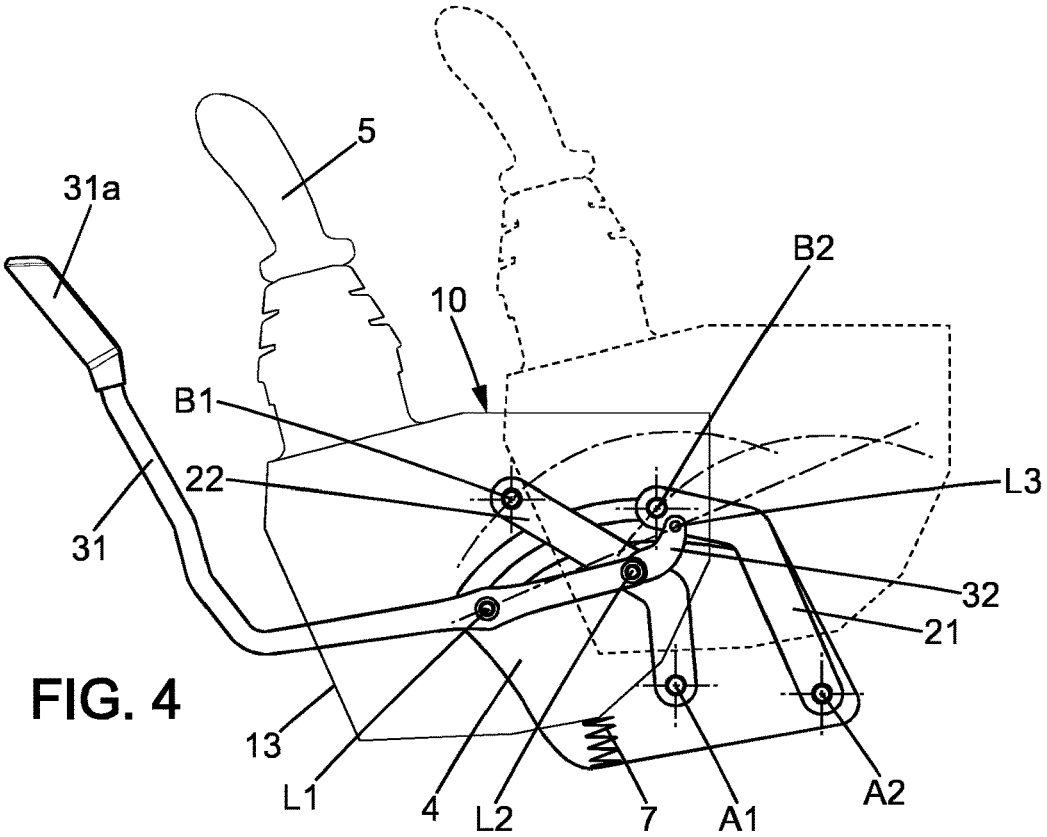

The locking means 30 are said in an unlocked state when the axis L2 is under a line joining the axis L1 and the axis L3 as shown in FIG. 4. The locking means 30 remain in the unlocked state through the all range of motion of the main body 10 between the retracted position and the work position. Likewise, the locking means 30 are said in a locked state when the axis L2 is above a line defined by the axis L1 and the axis L3 as shown in FIG. 5. The locked state of the locking means 30 is only reachable when the main body 10 is the work position.

As a toggle clamp linkage, alignment of pivotal connections around axis L1, L2 and L3 of the first locking lever 31 and the second locking lever 32 creates an intermediate unstable state of the locking means 30. The intermediate unstable state is an unstable mechanical equilibrium. Therefore, the locking means 30 tend to spontaneously move further away from the intermediate unstable state.

Figure 6:
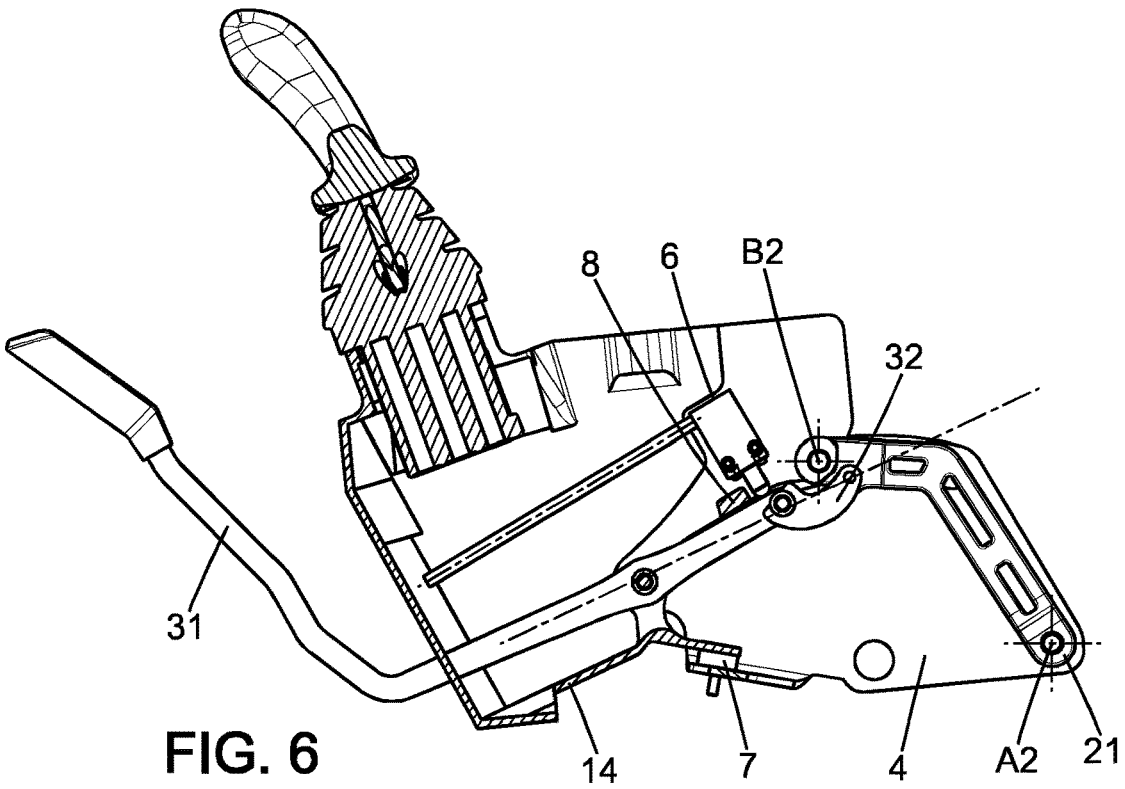
FIG. 6 illustrates the control module according to a first embodiment with the main body in the work position.

An abutment 8 is provided on the inner side of the inner wall 11 of the main body 10 as shown in FIGS. 5 and 6. The abutment 8 is adapted to cooperate with the first locking lever 31 when the locking means 30 are in a locked state, in order to stop the range of motion of the locking means 30.

Figure 7:
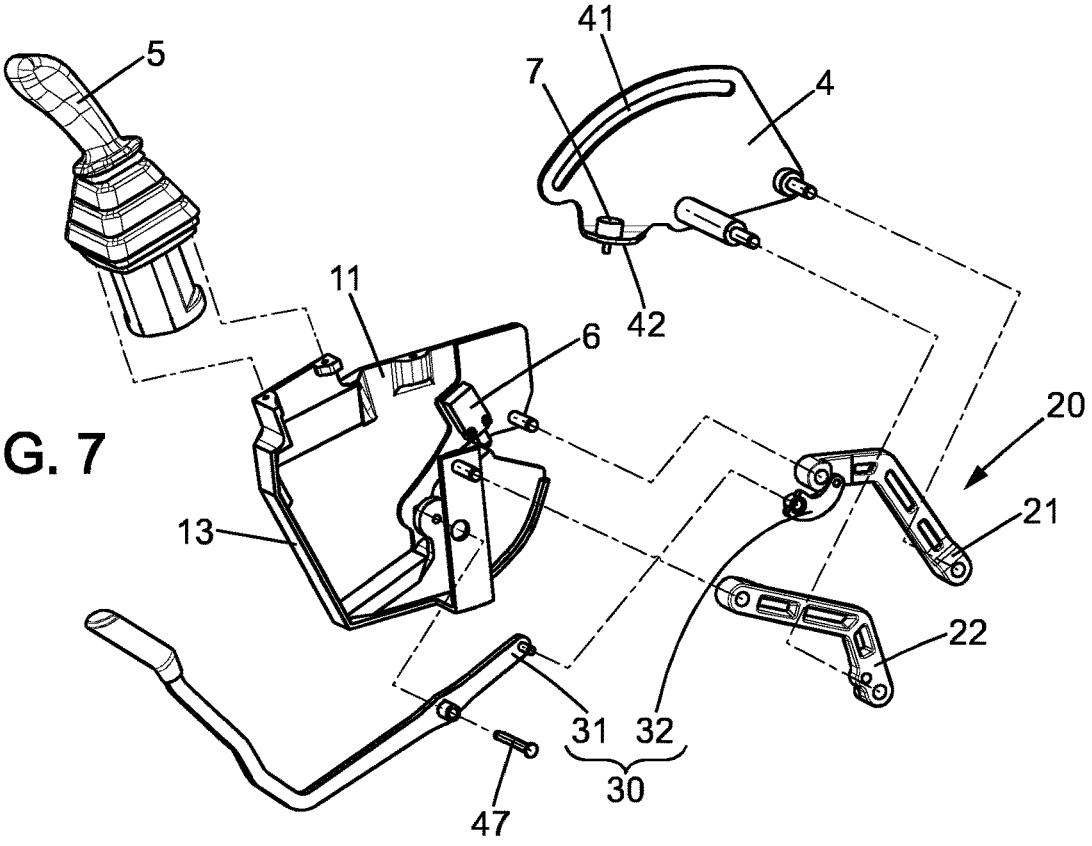
FIG. 7 is an exploded view of the control module according to a first embodiment.
Figure 8A:
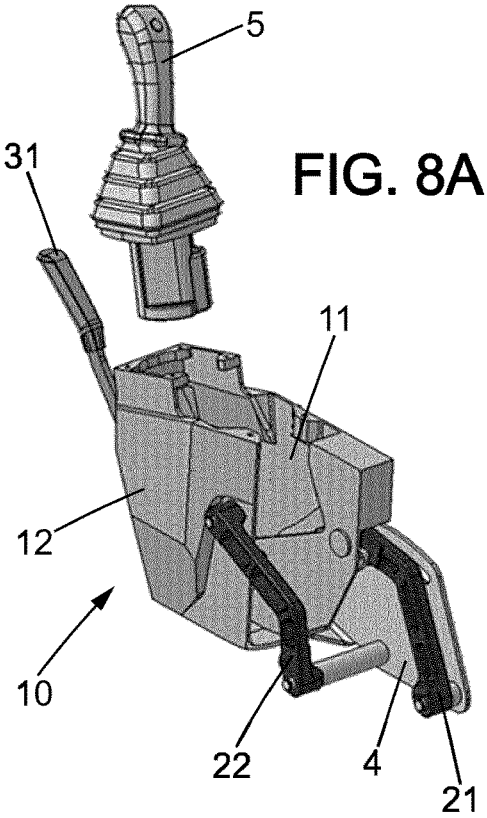
FIG. 8 is a rear perspective view of the control module according to a first embodiment, FIG. 9 diagrammatically illustrates the control module according to a second embodiment with the main body in the retracted position, FIG. 10 diagrammatically illustrates the control module according to a second embodiment with the main body between the retracted position and the work position.
Figure 8B:
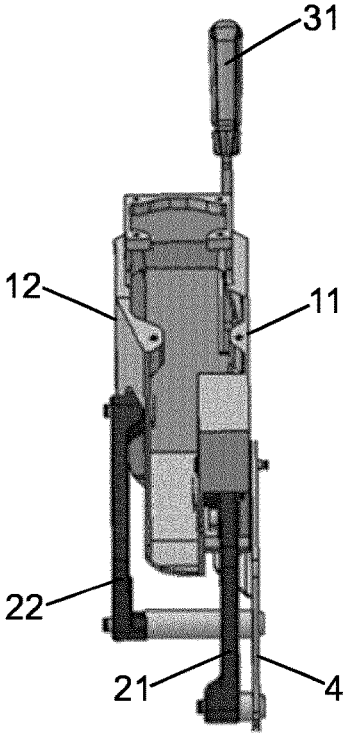
Figure 11:
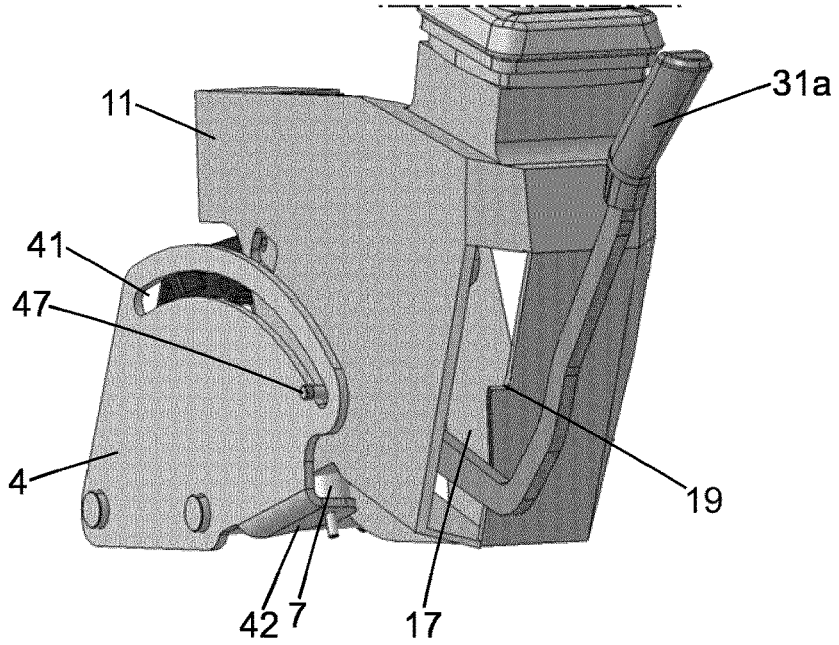
FIG. 11 is a front perspective view of the control module according to a first embodiment.

An elastic means is provided between the fixed support 4 and the main body 10. The elastic means is typically a rubber pad 7, as represented in FIGS. 6, 7 and 11 but any other types of suitable elastic means may be used. The rubber pad 7 is attached at one end to a top surface the tab portion 42 of the support 4. The other end of the rubber pad 7 is adapted to be abutted against the bottom wall 14 of the main body 10.

The rubber pad 7 is arranged so as to be compressed by the main body 10 to enable the transfer of the locking means 30 between the unlocked state and the locked state by reaching the intermediate unstable state. The intermediate unstable state of the locking means 30 corresponds to a forward end position FEP of the main body. The main body 10 in its forward end position FEP provokes peak compression stress of the rubber pad 7. Besides, the elastic means forces the main body 10 to move backward and simultaneously indirectly forces the locking means 30 in a direction away from the intermediate unstable state to remain either in the unlocked state or in the locked state, according to which state they initially are.

For example, if the locking means 30 are operated to move from the unlocked state in direction of the intermediate unstable state but are released before reaching said intermediate unstable state, then the locking means 30 automatically move back to the unlocked state (under the return force of the elastic means). Precisely, the locking means 30 move back to a specific configuration wherein the elastic means 7 has regained its initial shape and is in contact against the bottom wall 14 of the main body 10 (without any compression).

Inversely, if the locking means 30 are operated to move from the locked state in direction of the intermediate unstable state but are released before reaching said intermediate unstable state, then the locking means 30 automatically move back to the locked state (under the return force of the elastic means).

In another embodiment not shown, the elastic means is positioned between the at least one pivotable rod of the guiding means 20 and a tab portion 42 of the support 4 positioned to face the at least one pivotable rod of the support 4.

Abutment 8 is also positioned such that when the first locking lever 31 abuts the abutment 8, the rubber is not completely released from the main body 10. Therefore, the first locking lever 31 is urged toward the abutment 8 while being stopped by it. The locking means 30 are then locked in the locked state. The main body 10 is locked accordingly.

The fact that, in the work position, the elastic means 7 remains compressed and therefore exerts on the main body 10 an elastic return force tending to push the main body 10 backwards, i.e. in direction of the retracted position, enables to correct any mechanical clearance between the moving parts of the module 1.

Also, a sensor 6 is provided to be actuated by the locking means 30 when they are moved from the intermediate unstable state to the locked state. The sensor 6 enables the activation of at least one power circuit of the machine controlled by the joystick 5.

Accordingly, the sensor 6 is arranged so that it is activated only when the locking means 30 have reached the intermediate unstable state. This means that the sensor 6 is activated when the main body 10 is in the work position or almost in the work position. In particular, the sensor 6 is a contact sensor 6. A moving part of the contact sensor 6 is arranged to be pushed by the first locking lever 31 as it is represented in FIGS. 5 and 6. Furthermore, the contact sensor 6 can be calibrated based on the position of the abutment 8. It ensures a precise location of the contact sensor 6 and guarantees that the contact sensor 6 will not be actuated before that the locking means 30 have overcome the intermediate unstable state. Also, calibrating the sensor 6 based on the abutment 8 position prevents the contact sensor 6 from damages that could be inflicted by the first locking lever 31.

The mechanism of moving the main body 10 between the retracted position and the work position will now be described in reference to FIGS. 3 to 5 and FIG. 12.

The FIG. 3 shows the control module 1 with the main body 10 located in the retracted position. One can notice that the inner end of the transversal shaft 47 aligned with axis L1 abuts the rear end of the first arcuate slot 41 of the support 4. Also, the first locking lever 31 is retained by the shoulder 19 defined on the outer edge of the vertical slot 17 of the main body 10 ensuring that the locking means 30 are locked. It is therefore not possible to move the main body 10 away from the retracted position because this latest is coupled to the locking means 30. This is particularly advantageous because it ensures that the passage in and out of the control station 3 of the machine remains free while a user moves in or out of the control station 3. It is also advantageous because it prevents the main body 10 to be moved away from the retracted position and eventually be damaged when the machine is carried out for transportation or shipment.

Figure 12:
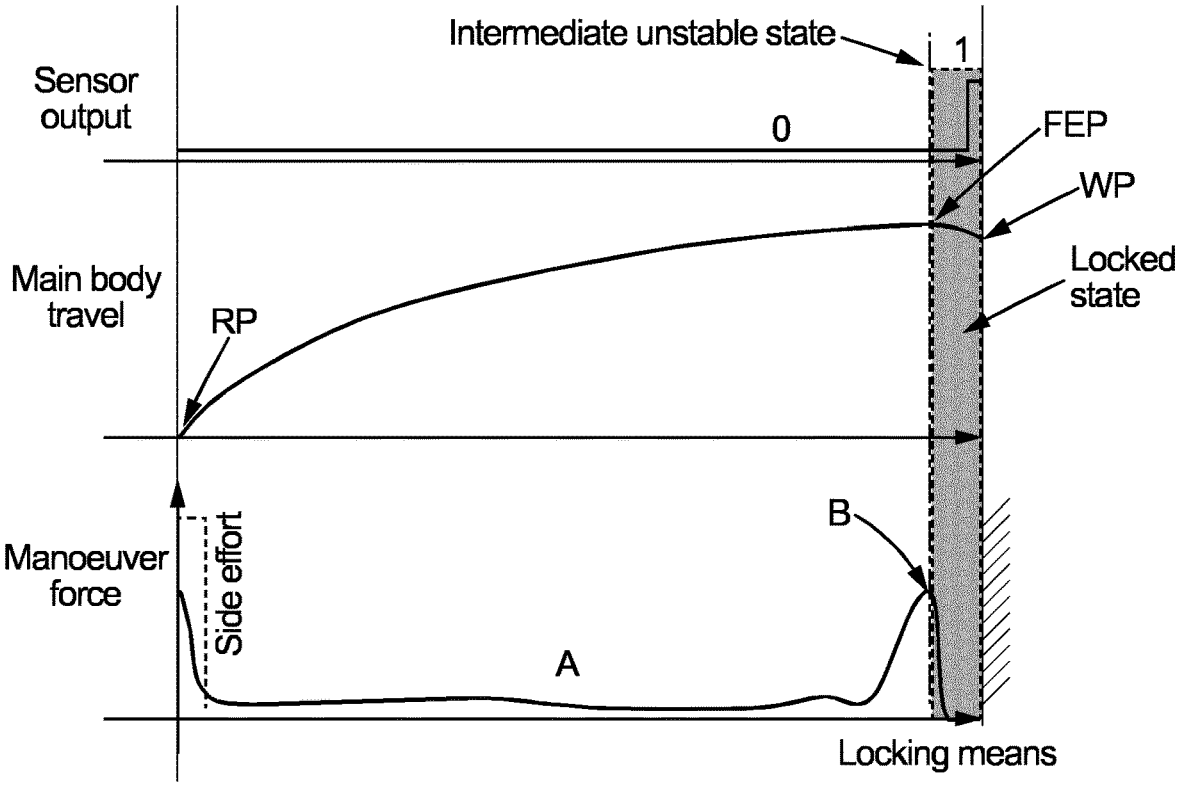
FIG. 12 is chart illustrating the control module operations from the retracted position to the work position.

In order to unlock the locking means 30, a side effort as represented in FIG. 12 has to be exerted by the user to slightly inwardly bend the first locking lever 31 and to release it from the shoulder 19.

Referring to FIG. 12, a forward manoeuver force A is then applied to the operating handle 31*a* of the first locking lever 31 to push it forwardly. The main body 10 is moved accordingly with a motion a circular translation from the retracted position of FIG. 3 to the working position of FIG. 4. During all range of motion of the main body 10, the locking means 30 remains in the unlocked state as the axis L2 remains under the line joining the axis L1 and the axis L3. The forward manoeuver force depends upon orientation of the first arcuate slot 41 and upon friction of of the transversal pin 47 sliding in the first arcuate slot 41. According to an embodiment of the invention, the manoeuver force A may have a value being zero or near to zero.

FIG. 4 shows the main body 10 with its bottom wall 14 abutting the elastic means 7. Also, the axis L2 being under the line joining the axis L1 and the axis L3, the locking means 30 are still in the unlocked state. Besides, the inner end of the transversal shaft 47 aligned with the axis L1 is now near to the forward end of the first arcuate slot 41 of the support 4.

From the position of FIG. 4, a higher effort shall now be exerted so to reach a threshold effort B as seen in FIG. 11. The effort B allows the compression of the rubber pad 7 required for reaching the forward end position FEP of the main body 10 aligning the axis L1, L2 and L3 and thus required for reaching the intermediate unstable state of the locking means 30. Once this intermediate unstable state has been overcome, the locking means 30 are then in the locked state.

Pressure on the handle of the first locking lever 31 might then be released. The rubber pad 7 forcing the main body 10 backwards provokes the locking means 30 in the locked state to move further away from the intermediate unstable state. The axis L2 is displaced further above of the line joining the axis L1 and the axis L3. The displacement of the locking means 30 is then stopped when the first locking lever 31 abuts the abutment 8. The main body 10 is the in the work position WP. Simultaneously, the first locking lever 31 reaches the contact sensor 6 and actuates it for enabling the activation of at least one power circuit of the machine controlled by the joystick 5. The main body 10 is then in the working position with the locking means 30 in the locked state as represented in FIG. 5.

Furthermore, the rubber pad 7 is advantageously not completely released when the main body 10 is in the configuration of FIG. 5. Therefore, the rubber pad 7 maintains tension on the main body 10 and all the elements of the control module 1 which are connected to the main body 10. This tension guarantees the locking of the locking means 30 and the main body 10. This tension distributed in all the elements also generates solidity and compactness of the whole control module 1 during operations. It also ensures to keep the locking lever in contact with the contact sensor 6.

Overall safety is then improved because the hydraulic powered functions of the machine cannot be actuated until the main body 10 is in the work position and with the locking means 30 in the locked state. Contrary to the known techniques, the hydraulic functions of the machine cannot be actuated while the main body 10 of the control module 1 is between the retracted position and the work position unlocked.

In a various embodiment not shown, the control module 1 may further comprise an emergency system. The emergency system is adapted to move the locking means 30 in the locked state toward the unlocked state in order to relieve the contact sensor 6 from the first locking lever 31 which has for consequences to deactivate the functions of the machine. More specifically, the emergency is designed as rod connected to a pushbutton for external action on the emergency system. The rod is adapted to be pushed on the locking means 30 to force the axis L2 to move under the line joining the axis L1 and the L3. The emergency system enables a faster deactivation of the hydraulic functions of the machine than unlocking the locking system by compressing back the elastic means in order to move the locking means 30 from the locked state to the unlocked state. The emergency system can also deactivate the functions of the machine if for any reason the locking means 30 are blocked.

Control module 1
Cabin 2
Control station 3
Joystick 5
Support 4
First arcuate slot 41
Tap portion 42
Second arcuate slot 43
Transversal pin 47
Main body 10
Inner wall 11
Outer wall 12
Forward wall 13
Bottom wall 14
Top wall 15
Transversal pin 16
Vertical slot 17
Recess 18
Shoulder 19
Sensor 6
Rubber pad 7
Abutment 8

Guiding means 20
First pivotable rod 21
Second pivotable rod 22
Locking means 30
First locking lever 31
Second locking lever 32
Handle 31*a*

The invention claimed is:

1. A control module configured to be part of a control station inside a cabin of a machine, the control module comprising:

a fixed support;

a main body movably mounted on the support between a work position and a retracted position;

locking means to lock the main body in the work position, the locking means being operable between an unlocked state in which they do not prevent the main body from moving and a locked state in which they keep the main body in its work position, wherein between the unlocked state and the locked state, the locking means reach an intermediate unstable state, wherein the control module also includes an elastic means which is compressed when the locking means are operated between the unlocked state and the intermediate unstable state and which forces the locking means in a direction away from the intermediate unstable state, wherein the control module also includes a sensor enabling activation of at least one power circuit of the machine, and wherein the sensor is arranged to be actuated only when the locking means move from the intermediate unstable state to the locked state.

2. The control module according to claim 1, wherein the main body can be moved from the retracted position to the work position, and inversely, by operating the locking means.

3. The control module according to claim 1, further including guiding means for guiding the main body in its movement relative to the support, the guiding means comprising at least one pivotable rod.

4. The control module according to claim 3, wherein the guiding means provide to the main body a motion of circular translation relative to the support.

5. The control module according to claim 1, wherein the main body includes an armrest.

6. The control module according to claim 1, wherein the locking means comprise a first locking lever extending from a first end to a second end, the first locking lever being pivotally connected at an intermediate location between the first end and the second end to the main body for rotation around a first axis and pivotally connected at the second end to a first end of a second locking lever for rotation around a second axis spaced apart from the first axis, a second end of the second locking lever being connected to at least one pivotable rod that enables guiding the main body in its movement relative to the support, for rotation around a third axis spaced apart from the first axis and the second axis, the first locking lever and the second locking lever forming a toggle clamp linkage.

7. The control module according to claim 1, wherein the locking means comprise an operating handle.

8. The control module according to claim 6, wherein the operating handle is located at the first end of the first locking lever and wherein the dimension of the first locking lever between the axis L1 and the axis L2 is superior to the dimension of the second locking lever between the axis L2 and the axis L3.

9. The control module according to claim 6, wherein the main body comprises an abutment to cooperate with the first locking lever when the locking means are in the locked state.

10. The control module according to claim 1, wherein the elastic means is a rubber pad attached to the support and adapted to be compressed by the main body.

11. The control module according to claim 1, wherein the sensor is a contact sensor arranged to be actuated by the locking means.

12. The control module according to claim 1, further comprising an emergency system adapted to move the locking means from the locked state towards the unlocked state in order to de-activate the sensor.

13. The control module according to claim 1, further comprising holding means for holding the main body in the retracted position.

14. The control module according to claim 13, wherein the holding means comprise a shoulder configured to retain the locking means when the main body is in the retracted position.

15. The control module according to claim 1, further comprising a joystick for controlling functions of the machine, the joystick being mounted on the main body.

16. The control module according to claim 1, wherein the return force of the elastic means forces the locking means to move from the intermediate unstable state to the locked state.

17. The control module according to claim 1, wherein the operation of the locking means between the unlocked state and the intermediate unstable state forces the main body to move, from its retracted position, forward and wherein the elastic return force of the elastic means forces the locking means to move from the intermediate unstable state to the locked state and forces simultaneously the main body to move backwards until it reaches the work position.

18. The control module according to claim 1, wherein, in the work position, the elastic means remains compressed and therefore exerts on the main body an elastic return force tending to push the main body backwards in direction of the retracted position.

19. The control module according to claim 1, wherein the compressive force of the elastic means is maximum when the locking means are in the intermediate unstable state.

20. A control station, comprising a seat and a control module according to claim 1.

21. A construction machine comprising a control station according to claim 20.

* * * * *